US012331744B2

(12) United States Patent
Seto

(10) Patent No.: US 12,331,744 B2
(45) Date of Patent: Jun. 17, 2025

(54) AIR COMPRESSOR

(71) Applicant: Foon Seto, Edmonton (CA)

(72) Inventor: Foon Seto, Edmonton (CA)

( * ) Notice: Subject to any disclaimer, the term of this patent is extended or adjusted under 35 U.S.C. 154(b) by 0 days.

(21) Appl. No.: 18/210,023

(22) Filed: Jun. 14, 2023

(65) Prior Publication Data

US 2024/0418168 A1 Dec. 19, 2024

(51) Int. Cl.
*F04C 18/22* (2006.01)
*F04C 19/00* (2006.01)
*F04C 29/12* (2006.01)

(52) U.S. Cl.
CPC ..... *F04C 18/22* (2013.01); *F04C 19/005* (2013.01); *F04C 29/12* (2013.01)

(58) Field of Classification Search
CPC ..... F04C 18/22; F04C 19/005; F04C 29/12; F04C 29/122; F02B 53/00; F02B 2053/005
See application file for complete search history.

(56) References Cited

U.S. PATENT DOCUMENTS 4,018,548 A * 4/1977 Berkowitz ..... F04C 18/22 418/61.2
4,047,856 A * 9/1977 Hoffman ..... F01C 1/22 418/61.2
4,105,375 A * 8/1978 Schindelhauer ..... F04C 18/22 418/54
2017/0204857 A1* 7/2017 Garside ..... F04C 27/006

FOREIGN PATENT DOCUMENTS

JP 2002309951 A * 10/2002 ..... F02B 53/00

OTHER PUBLICATIONS

De19920289c1—Schapiro et al.—Rotary Piston Internal Combustion Engine Has Rotary Piston Oval in Cross-section Rotatably Located in Chamber in Housing and Having Face-side End Plates, With Oval Longitudinal Bore Corresponding to Its Cross sectional Contour—Jul. 6, 2000—English Machine Translation. (Year: 2000).*
JP2002309951A—Ito et al.—Basic Structure of Composite Circle Rotary Engine—Oct. 23, 2002—the English Machine Translation. (Year: 2002).*

* cited by examiner

*Primary Examiner* — Theresa Trieu
(74) *Attorney, Agent, or Firm* — Ying-Ting Chen; Law Office of Michael Chen

(57) ABSTRACT

An air compressor includes a compressor body; a rotator located inside the compressor body and configured to define an exhaust compartment and an intake compartment; a plurality of exhaust openings and a plurality of intake openings formed on the compressor body; wherein the rotator is rotated within the compressor body to operate exhaust and intake cycles.

18 Claims, 8 Drawing Sheets

AIR COMPRESSOR

FIELD OF THE DISCLOSURE

The present disclosure relates to an air compressor, and more particularly, the air compressor a triangle compressor body with a fusiform shape/football shape that is wide in the body portion and tapers at both end portions.

BACKGROUND OF THE DISCLOSURE

Generally, the air compressors used in a steamer, in a tank and an armoured personnel carrier provide high power with high fuel consumption. Therefore, there is a continuing need of the air compressors to provide high power with low fuel consumption.

The air compressors in the current market have the piston with the reciprocating motion in a compressor body, wherein the crankshaft is coupled to a motor and is connected to the piston via a connection rod. The reciprocating motion of the piston in the air compressor has the following disadvantages: 1. The piston motion is limited by the length of the crankshaft and the connection rod. 2. The power generated by the piston is converted to the rotation power for the crankshaft and the connection rod, and during the convention, it is inevitable to generate energy loss. 3. The energy loss is also generated by the friction between the piston and the compressor body. 4. The inertia energy loss is generated by the reciprocating motion of the piston.

Another improved type of air compressor has a triangle shape of rotator; however, this improved type of air compressor still could not provide the high power with lower fuel consumption.

All referenced patents, applications and literature are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, the air compressor may comprise a compressor body; a rotator located inside the compressor body and configured to define an exhaust compartment and an intake compartment; a plurality of exhaust openings and a plurality of intake openings formed on the compressor body; wherein the rotator is rotated within the compressor body to operate exhaust and intake cycles.

In another aspect combinable with the general implementation, the rotator is clockwisely rotated along a center point of the rotator within the compressor body.

Further, it is contemplated that the rotator has a fusiform shape/football shape and has a wider body portion, wherein two sides of the wider body portion taper to form two end portions.

In the alternative, the rotator comprises an end portion having a trapezoid shape, wherein the end portion comprises a flat surface where a rotatable axis is passed through and coupled to a motor to activate the exhaust and intake cycles.

It is still further contemplated that the compressor body comprises a first point, a second point, and a third point, wherein the compressor body comprises a first periphery defined between the first point and the second point, a second periphery defined between the second point and the third point, and a third periphery defined between the third point and the first point.

The contemplated rotator can rotate sixty degrees within the compressor body to operate one exhaust and intake cycle.

In one embodiment, the rotator comprises a front end biased against an inner surface of the compressor body and a rear end biased against the inner surface of the compressor body, wherein a rotator length is defined by the front end and the rear end.

Another aspect of the embodiment is directed to that the rotator comprises a front end and a rear end, and a rotator length defined by the front end and the rear end, wherein the rotator length is smaller than a length of the first periphery, a length of the second periphery, and a length of the third periphery.

In another aspect combinable with the general implementation, the compressor body comprises a first periphery integrally extended to a second periphery, and a third periphery integrally extended between the first and the second periphery.

In another aspect combinable with the general implementation, at least one of the plurality of exhaust openings is formed on each of the first periphery, the second periphery, and the third periphery.

In another aspect combinable with the general implementation, at least one of the plurality of intake openings is formed on each of the first periphery, the second periphery, and the third periphery.

In another aspect combinable with the general implementation, the rotator comprises a front end biased against the first point and a rear end is biased against the third point.

In another aspect combinable with the general implementation, during the exhaust and intake cycle, the front end of the rotator moves towards the second point and a volume of the exhaust compartment is gradually decreased with that a volume of the intake compartment is gradually increased.

In another aspect combinable with the general implementation, the rotator comprises a front end biased against the second point and a rear end is biased against the third point.

In another aspect combinable with the general implementation, during the exhaust and intake cycle, the rear end of the rotator moves towards the first point and a volume of the exhaust compartment is gradually decreased with that a volume of the intake compartment is gradually increased.

In another aspect combinable with the general implementation, the rotator comprises a front end moving along a first periphery of the compressor body and a rear end biased against a corner point located opposite of the first periphery, wherein the compressor body further comprises a second periphery and a third periphery located on two opposite sides of the rotator.

In another aspect combinable with the general implementation, during the exhaust and intake cycle, the exhaust opening formed on a third periphery of the compressor body configured to define the intake compartment is closed and the intake opening formed on the third periphery of the compressor body is opened.

In another aspect combinable with the general implementation, during the exhaust and intake cycle, the exhaust opening formed on a second periphery of the compressor body configured to define the exhaust compartment is closed and the intake opening formed on the second periphery of the compressor body is opened.

In another aspect combinable with the general implementation, during the exhaust and intake cycle, the exhaust opening and the intake opening formed on the first periphery are closed.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably. It shall be understood that the term "means," as used herein, shall be given its broadest possible interpretation in accordance with 35 U.S.C., Section 112 (f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

According to the following embodiments, in some embodiments, the first periphery, the second periphery, and the third periphery are three identical peripheries, and in such a way, the first periphery, the second periphery, and the third periphery may be generally described as a/the periphery.

According to the following embodiments, in some embodiments, the first point, the second point, and the third point are three corner points formed on the compressor body.

Figure 1:
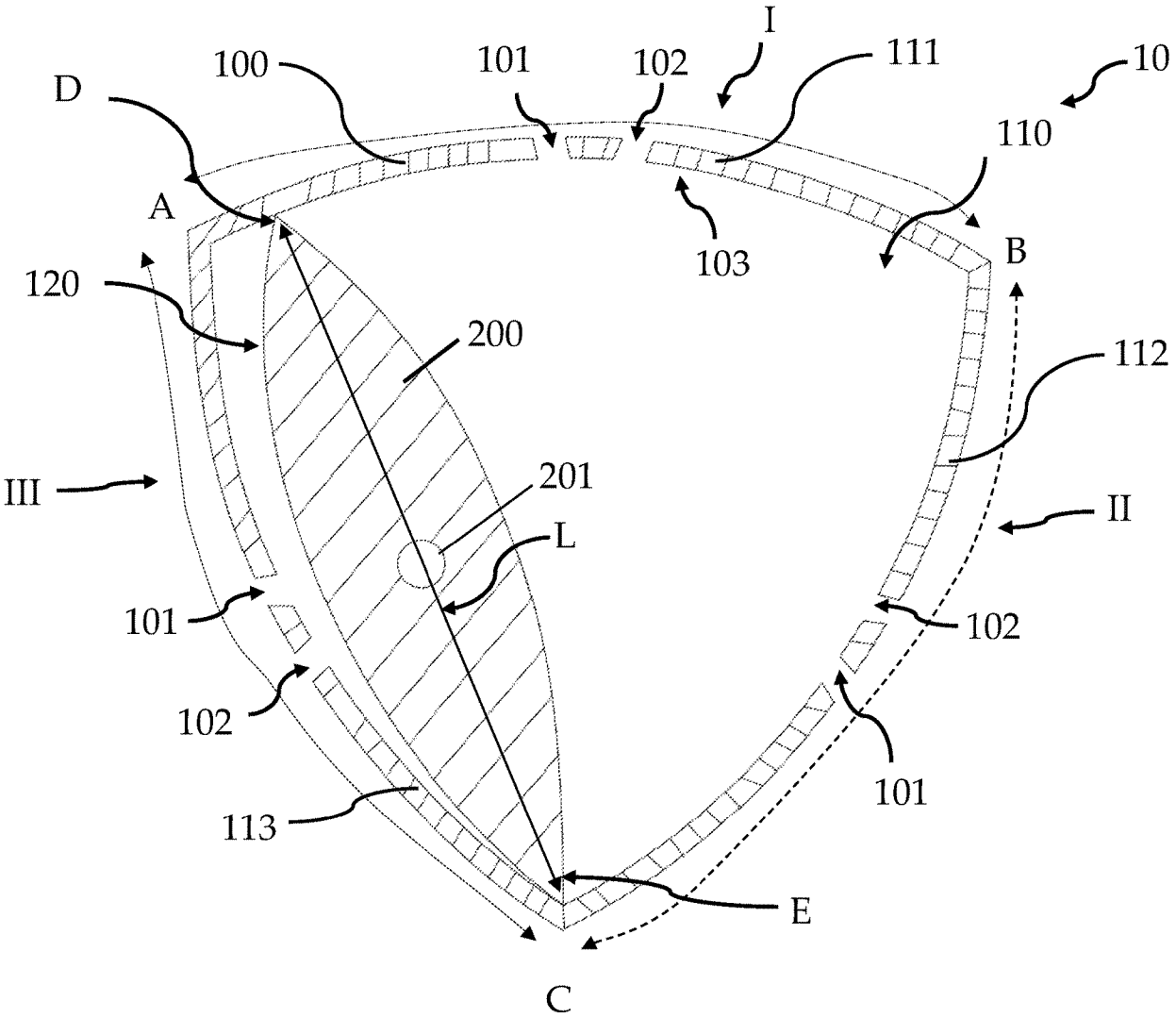
FIG. 1 is a top cross-sectional view of an air compressor according to an aspect of the embodiment.

FIG. 1 generally depicts an air compressor 10 according to an aspect of the embodiment.

Referring to FIG. 1, the air compressor 10 may further comprise a compressor body 100 and a rotator 200 located inside the compressor body 100, wherein the rotator 200 is configured to define an exhaust compartment 110 and an intake compartment 120 inside the compressor body 100. It should be noted that, in some embodiments, the compressor body 100 consists of the rotator 200 to define two isolated compartments, which is the intake compartment 120 and the exhaust compartment 110.

In some embodiments, the compressor body 100 may comprise a plurality of exhaust openings 101 and a plurality of intake openings 102 formed on the compressor body 100. In still some embodiments, the compressor body 100 comprises a first periphery 111 integrally extended to a second periphery 112, and a third periphery 113 integrally extended between the first periphery 111 and the second periphery 112. In still some embodiments, the exhaust openings 101 and the intake openings 102 are formed on the first periphery 111, the second periphery 112, and the third periphery 113.

In some embodiments, the compressor body 100 may be a triangle shape/triangular prism and may comprise a triangular shape cavity having a first point "A", a second point "B", and a third point "C", wherein the first point "A", the second point "B", and the third point "C" are spacedly arranged to define the first periphery 111, the second periphery 112, and the third periphery 113. In still some embodiments, the first periphery 111 is defined between the first point "A" and the second point "B", and the second periphery 112 is defined between the second point "B" and the third point "C", and the third periphery 113 is defined between the third point "C" and the first point "A".

In some embodiments, the first periphery 111 comprises a first peripheral length "I" defined between the first point "A" and the second point "B", and the second periphery 112 comprises a second peripheral length "II" defined between the second point "B" and the third point "C", and the third periphery 113 comprises a third peripheral length "III" defined between the first point "A" and the third point "C".

Figure 2:
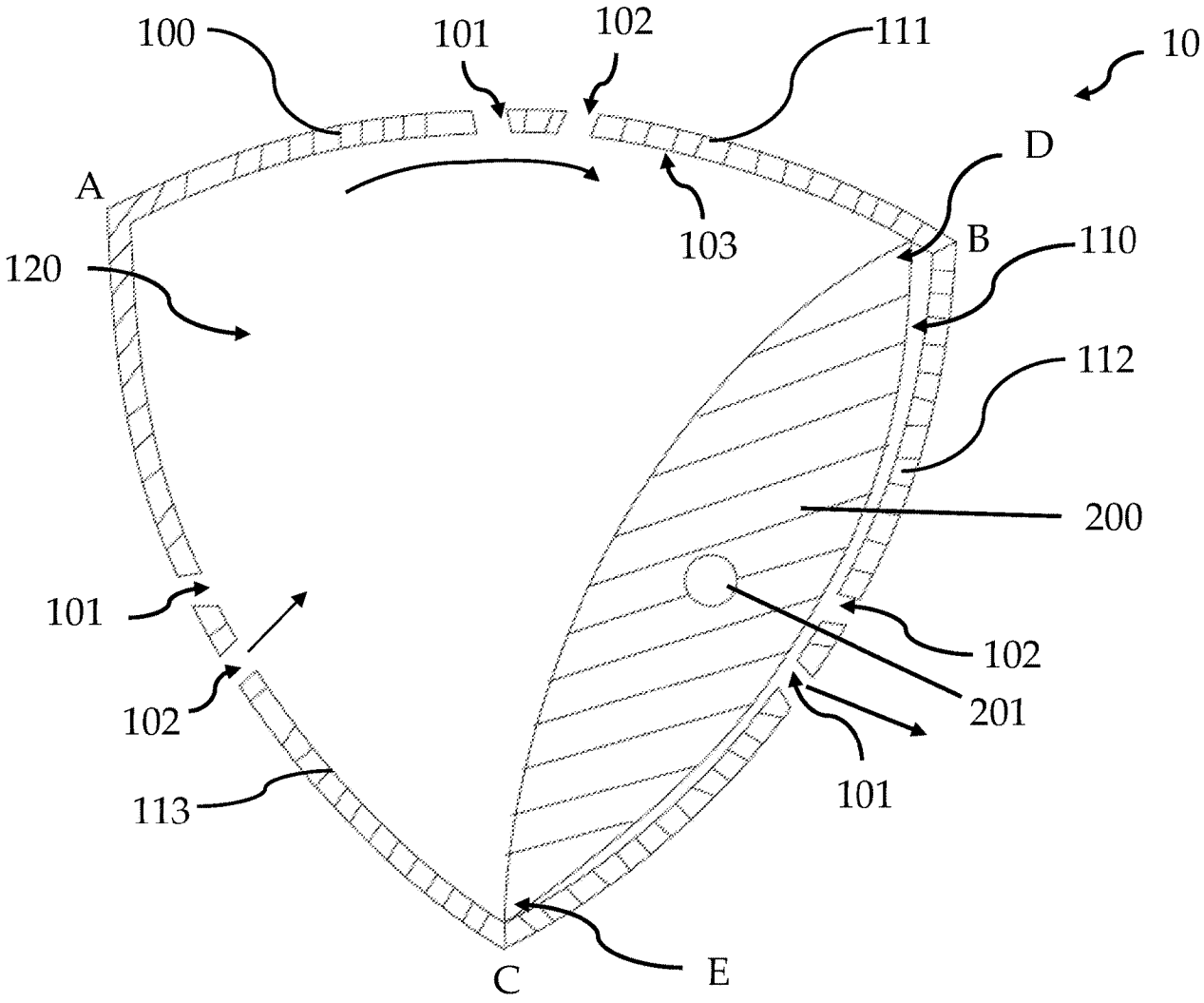
FIG. 2 is a top cross-sectional view of the air compressor showing an exhaust and intake cycle according to an aspect of the embodiment.

FIG. 2 generally depicts that the rotator 200 rotates at a predetermined degree within the compressor body 100 of the air compressor 10 according to an aspect of the embodiment.

Referring to FIG. 2, the rotator 200 may be rotated at a predetermined degree within the compressor body 100 to operate an exhaust and intake cycle. In one embodiment, the predetermined degree may be sixty degrees. In still one embodiment, the rotator 200 may continuously perform six times of exhaust and intake cycle, and during each exhaust and intake cycle, the rotator 200 rotates sixty degrees.

Continuing to FIGS. 1-2, in some embodiments, the rotator 200 may comprise a front end "D" biased against an inner surface 103 of the compressor body 100 and a rear end "E" biased against the inner surface 103 of the compressor body 100, wherein a rotator length "L" is defined by the front end "D" and the rear end "E", and in such a manner, the front end "D" of the rotator 200 may be located at an opposite side of the rear end "E" of the rotator 200.

As shown in further details in FIG. 2, the rotator length "L" defined by the front end "D" and the rear end "E" may be smaller than the first, second, and third peripheral length "I", "II", "III", and in such a manner, the rotator 200 may be rotated inside the compressor body 100. In some embodiments, the first periphery 111, the second periphery 112, and the third periphery 113 are arc-shaped.

With specific reference to FIG. 1 and FIG. 2, at least one of the plurality of exhaust openings 101 may be formed on each of the first periphery 111, the second periphery 112, and the third periphery 113. In some embodiments, at least one of the plurality of intake openings 102 may be formed on each of the first periphery 111, the second periphery 112, and the third periphery 113.

In some embodiments, the compressor body 100 may further comprise three corner points, including the first point "A", the second point "B", and the third point "C", wherein the front end "D" of the rotator 200 may be biased against one of the three corner points and a rear end "E" may be biased against the other one of the three corner points.

Turning now to FIGS. 1 and 2, during the exhaust and intake cycle, at the beginning of the exhaust and intake cycle, the front end "D" of the rotator 200 may be biased against the first point "A" of the three corner points and the rear end "E" may be biased against the third point "C" of the three corner points, as shown in FIG. 1. And, then, during the exhaust and intake cycle, the front end "D" of the rotator 200 may be moved towards the second point "B" of the three corner points and the volume of the exhaust compartment 110 is gradually decreased, and synchronously, the volume of the intake compartment 120 is gradually increased. According to the above-mentioned exhaust and intake cycle, the rotator 200 may be rotated at sixty degrees to perform one exhaust and intake cycle. It should be noted that, in some embodiments, the rotator 200 may be clockwisely rotated along a center point 201 of the rotator 200 within the compressor body 100.

In some embodiments, the front end "D" of the rotator 200 may be moving along the first periphery 111 of the compressor body 100 and the rear end "E" may be biased against the third point "C" of the three corner points located opposite of the first periphery 111.

Accordingly, in some embodiments, during the exhaust and intake cycle, the exhaust opening 101 formed on the third periphery 113 of the compressor body 100 configured to define the intake compartment 120 may be closed and the intake opening 102 formed on the third periphery 113 of the compressor body 100 may be opened. In such a situation, the exhaust opening 101 formed on the second periphery 112 of the compressor body 100 configured to define the exhaust compartment 110 may be opened and the intake opening 102 formed on the second periphery 112 of the compressor body 100 may be closed. Therefore, the air or fluid may be passed through the intake opening 102 formed on the third periphery 113 and enter into the intake compartment 120, and the air or the fluid inside the exhaust compartment 110 may be exhausted out via the exhaust opening 101 formed on the second periphery 112. It should be noted that, in some embodiments, during the exhaust and intake cycle, the exhaust opening 101 and the intake opening 102 formed on the first periphery 111 of the compressor body 100 may be closed.

Figure 3:
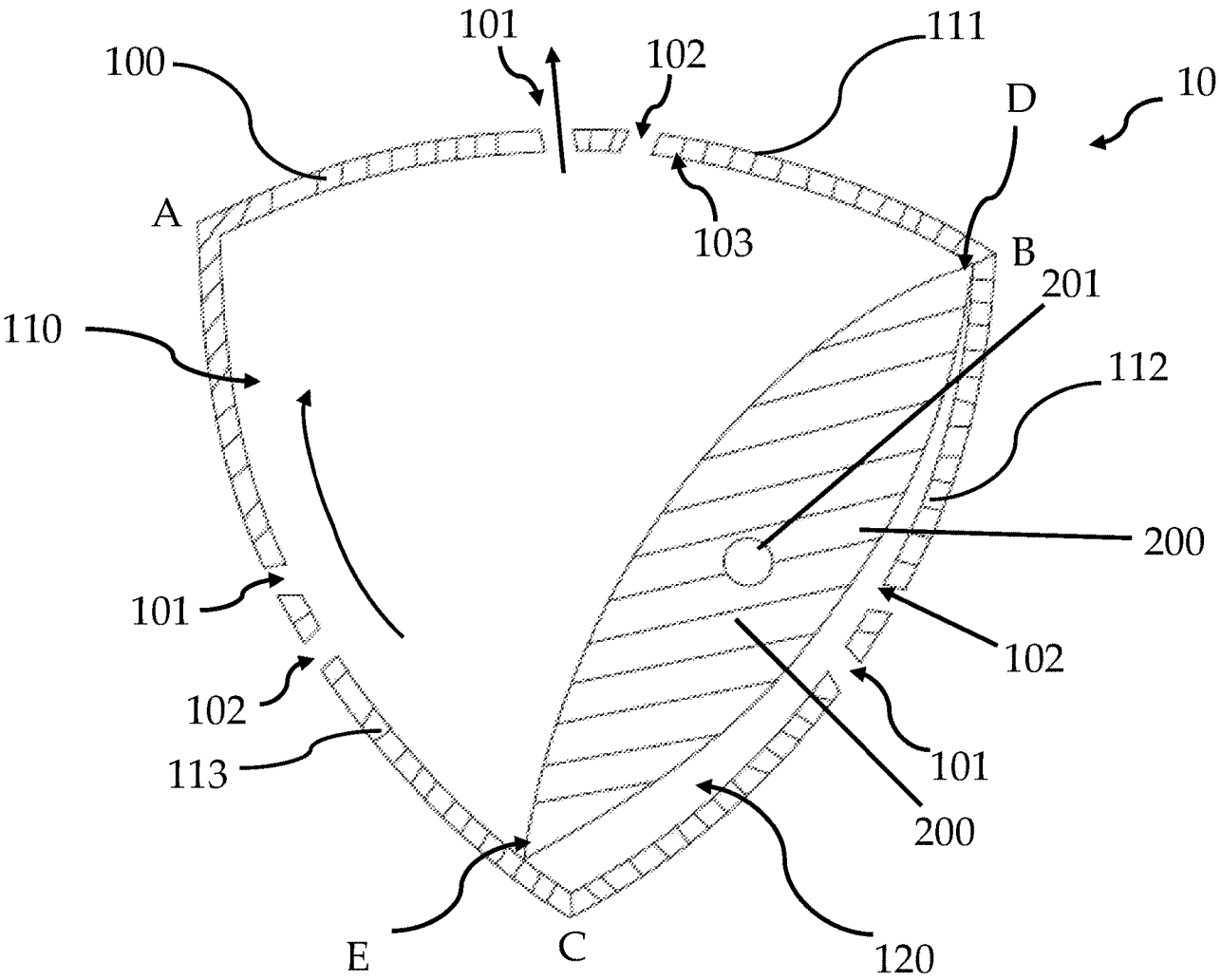
FIG. 3 is a top cross-sectional view of the air compressor showing a continuous exhaust and intake cycle according to an aspect of the embodiment.
Figure 4:
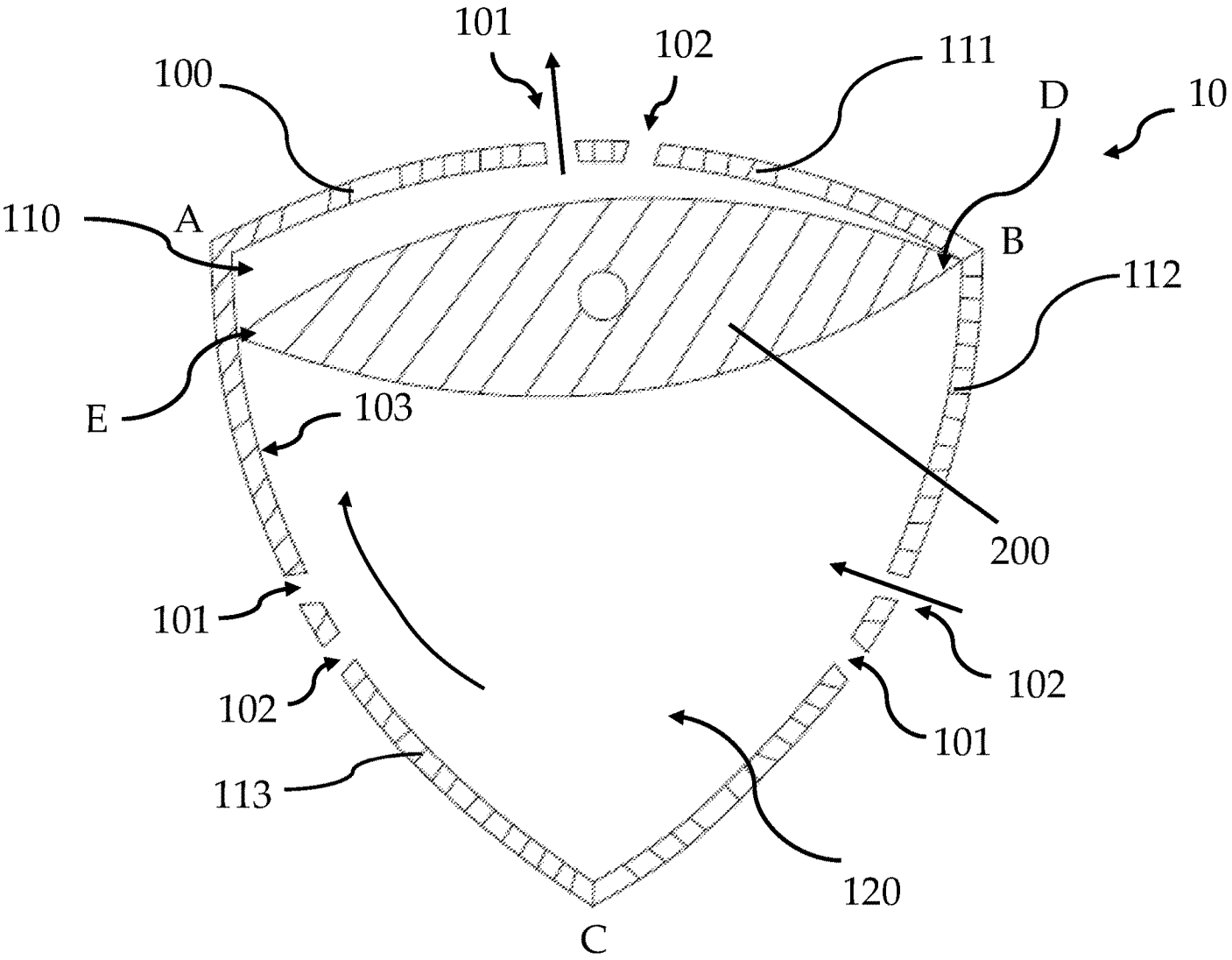
FIG. 4 is a top cross-sectional view of the air compressor showing the continuous exhaust and intake cycle according to an aspect of the embodiment.

FIGS. 3-4 generally depicts that the rotator 200 rotates the predetermined degree (sixty degrees) to continue a continuous exhaust and intake cycle according to an aspect of the embodiment.

Referring to FIG. 3, during the continuous exhaust and intake cycle, the rear end "E" of the rotator 200 may be moved towards the first point "A" of the three corner points and the front end "D" of the rotator 200 may be biased against the second point "B" of the three corner points, wherein the volume of the intake compartment 120 is gradually increased and synchronously the volume of the exhaust compartment 110 is gradually decreased. According to the above-mentioned continuous exhaust and intake cycle, the rotator 200 may be clockwisely rotated at sixty degrees along the center point 201 of the rotator 200 to perform the continuous exhaust and intake cycle.

In some embodiments, the rear end "E" of the rotator 200 may be moving along the third periphery 113 and the front end "D" may be biased against the second point "B" of the three corner points, wherein the second point "B" may be located opposite to the third periphery 113.

Accordingly, in some embodiments, during the continuous exhaust and intake cycle, the exhaust opening 101 formed on the second periphery 112 of the compressor body 100 configured to define the intake compartment 120 may be closed and the intake opening 102 formed on the second periphery 112 of the compressor body 100 may be opened. In such a situation, the exhaust opening 101 formed on the first periphery 111 of the compressor body 100 configured to define the exhaust compartment 110 may be opened and the intake opening 102 formed on the first periphery 111 of the compressor body 100 may be closed. Therefore, the air or the fluid may be passed through the intake opening 102 formed on the second periphery 112 and enter into the intake compartment 120, and the air or the fluid inside the exhaust compartment 110 may be exhausted out via the exhaust opening 101 formed on the first periphery 111. It should be noted that, in some embodiments, during the continuous exhaust and intake cycle, the exhaust opening 101 and the intake opening 102 formed on the third periphery 113 of the compressor body 100 may be closed.

Figure 5:
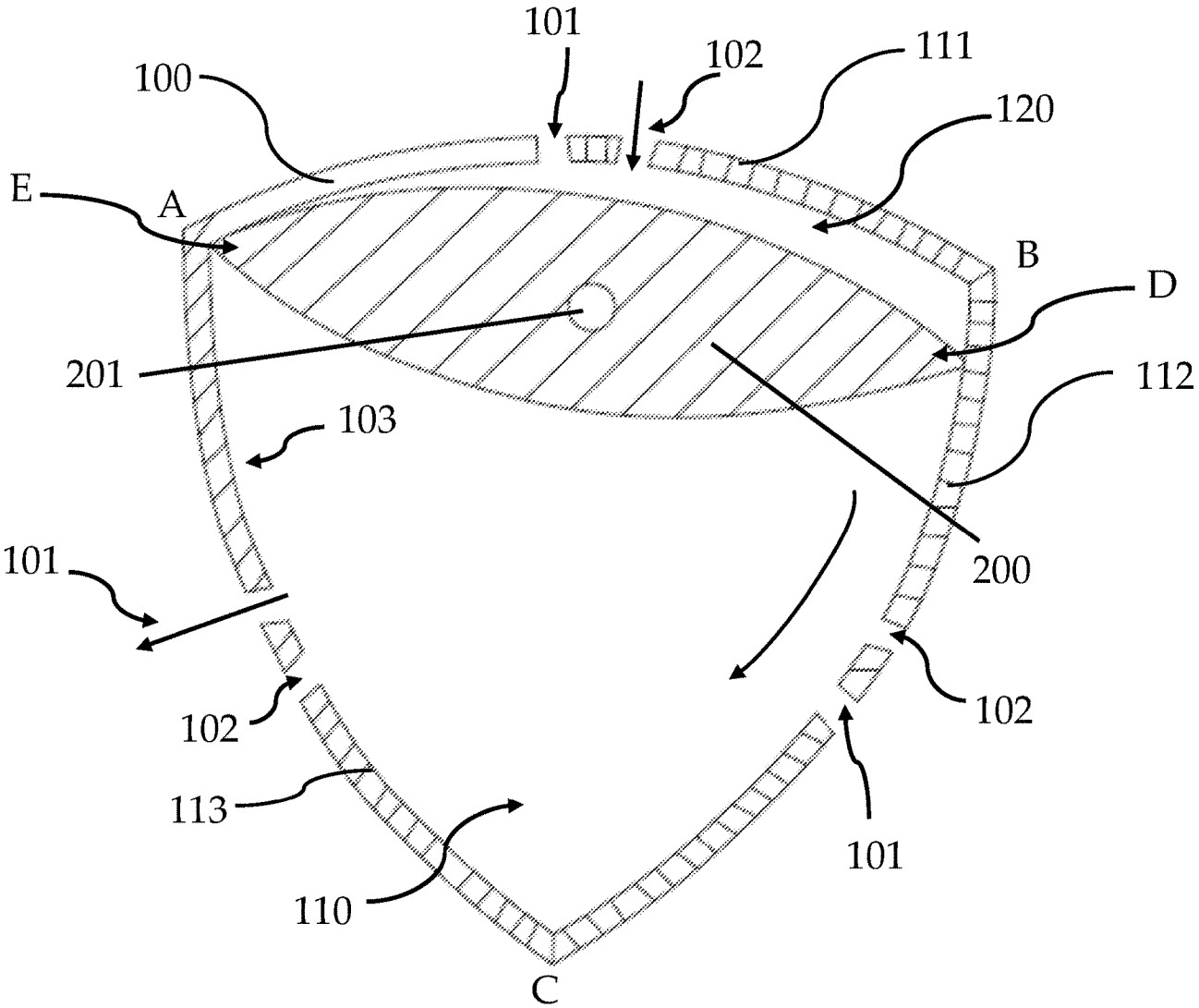
FIG. 5 is a top cross-sectional view of the air compressor showing a further continuous exhaust and intake cycle according to an aspect of the embodiment.
Figure 6:
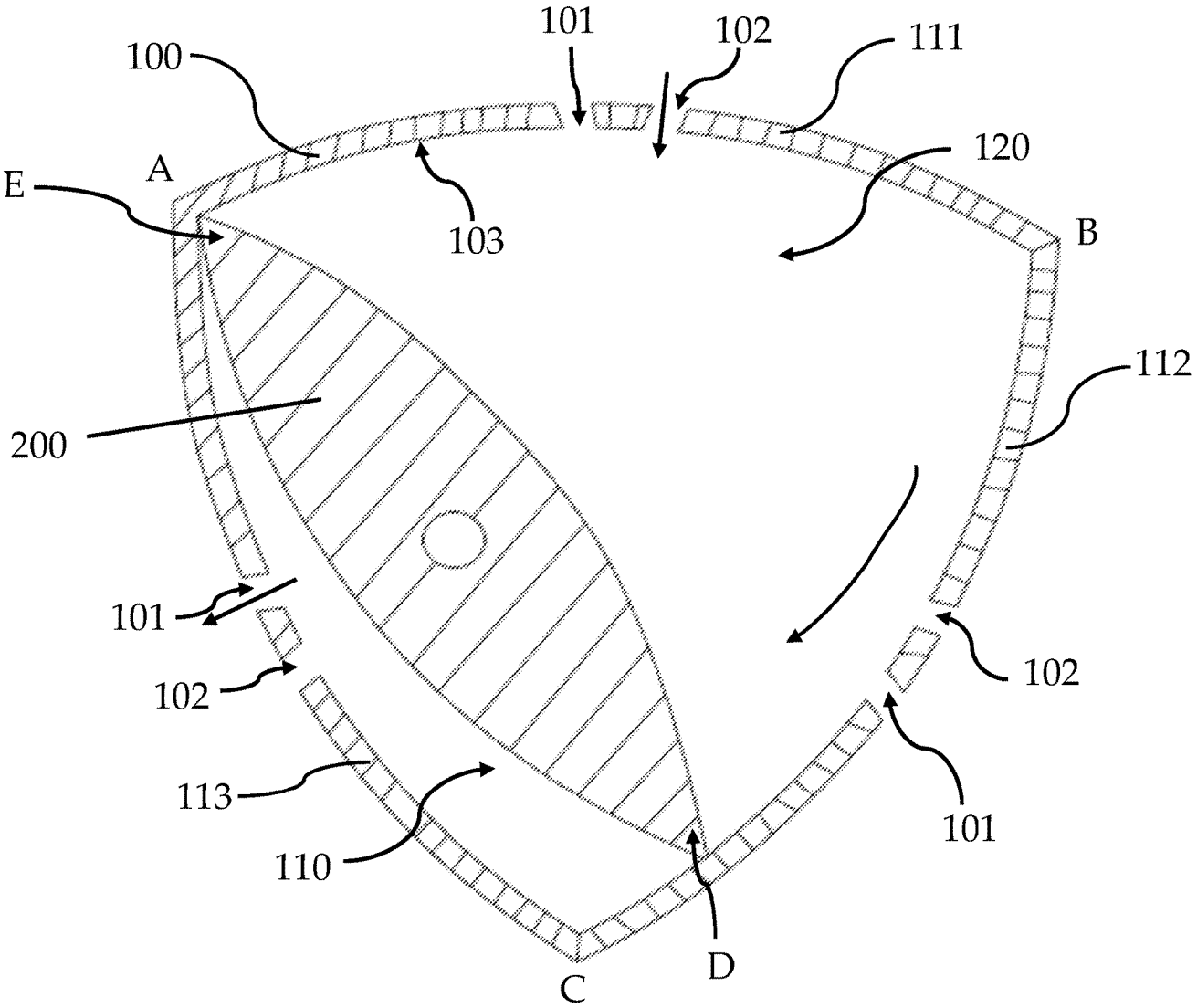
FIG. 6 is a top cross-sectional view of the air compressor showing the further continuous exhaust and intake cycle according to an aspect of the embodiment.

FIGS. 5-6 generally depict that the rotator 200 rotates the predetermined degree to continue a further continuous exhaust and intake cycle according to an aspect of the embodiment.

Referring to FIGS. 5-6, during the further continuous exhaust and intake cycle, the front end "D" of the rotator 200 may be moved towards the third point "C" of the three corner points and the rear end "E" of the rotator 200 may be biased against the first point "A" of the rotator 200, and in such a manner, the volume of the exhaust compartment 110 is gradually decreased, and synchronously, the volume of the intake compartment 120 is gradually increased. According to the above-mentioned further continuous exhaust and intake cycle, the rotator 200 may be clockwisely rotated at sixty degrees along the center point 201 of the rotator 200 to perform the further continuous exhaust and intake cycle.

Accordingly, in some embodiments, during the further continuous exhaust and intake cycle, the exhaust opening 101 formed on the first periphery 111 of the compressor body 100 configured to define the intake compartment 120 may be closed and the intake opening 102 formed on the first periphery 111 of the compressor body 100 may be opened. In such a situation, the exhaust opening 101 formed on the third periphery 103 of the compressor body 100 configured to define the exhaust compartment 110 may be opened and the intake opening 102 formed on the third periphery 113 of the compressor body 100 may be closed. Therefore, the air or the fluid may be passed through the intake opening 102 formed on the first periphery 111 and enter into the intake compartment 120, and the air or the fluid inside the exhaust compartment 110 may be exhausted out of the exhaust compartment 110 via the exhaust opening 101 formed on the third periphery 113. It should be noted that, in some embodiments, during the further continuous exhaust and intake cycle, the exhaust opening 101 and the intake opening 102 formed on the second periphery 112 of the compressor body 100 may be closed.

Figure 7:
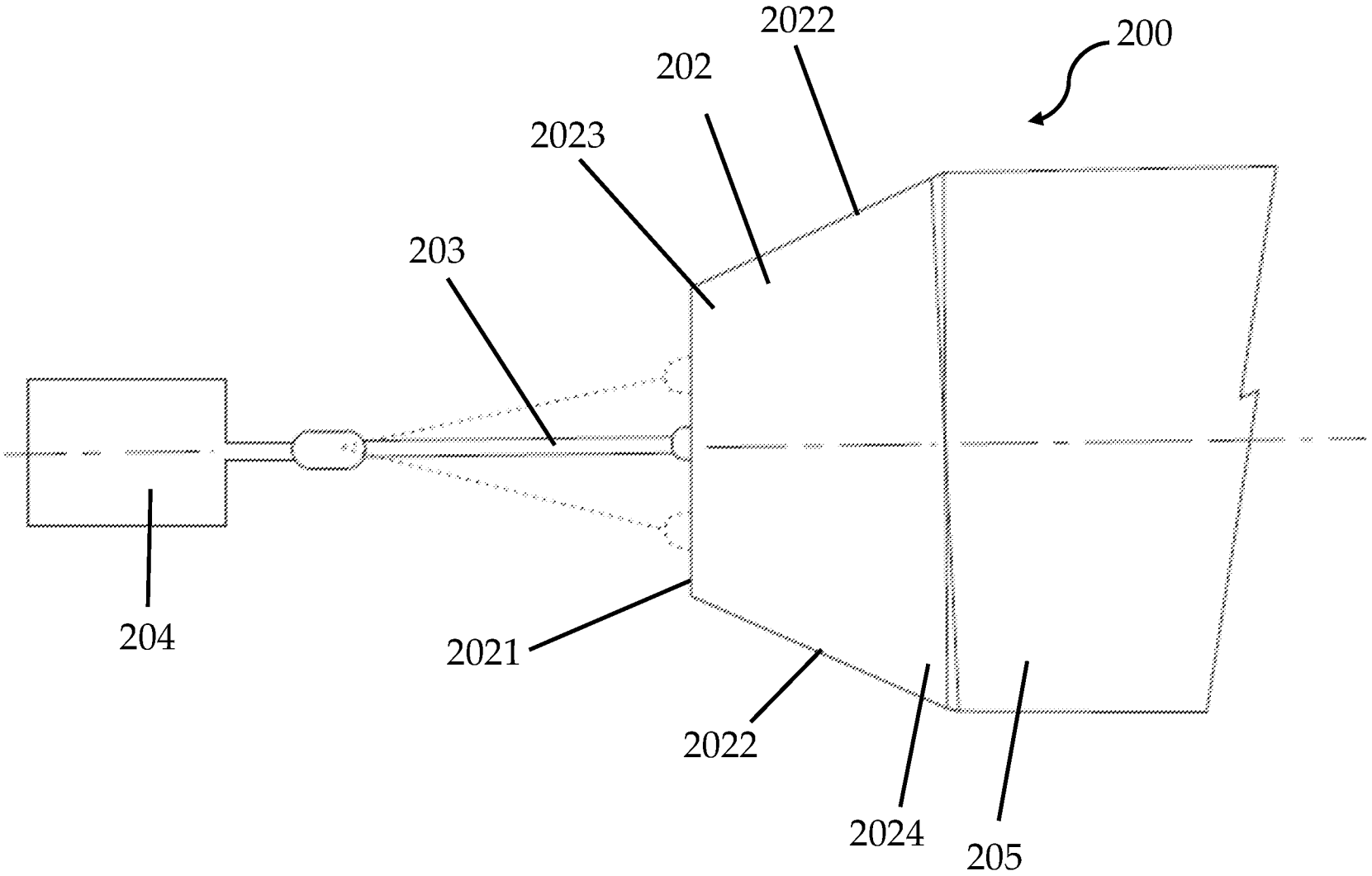
FIG. 7 is a cross-sectional view of a rotator connected with a motor according to an aspect of the embodiment.
Figure 8:
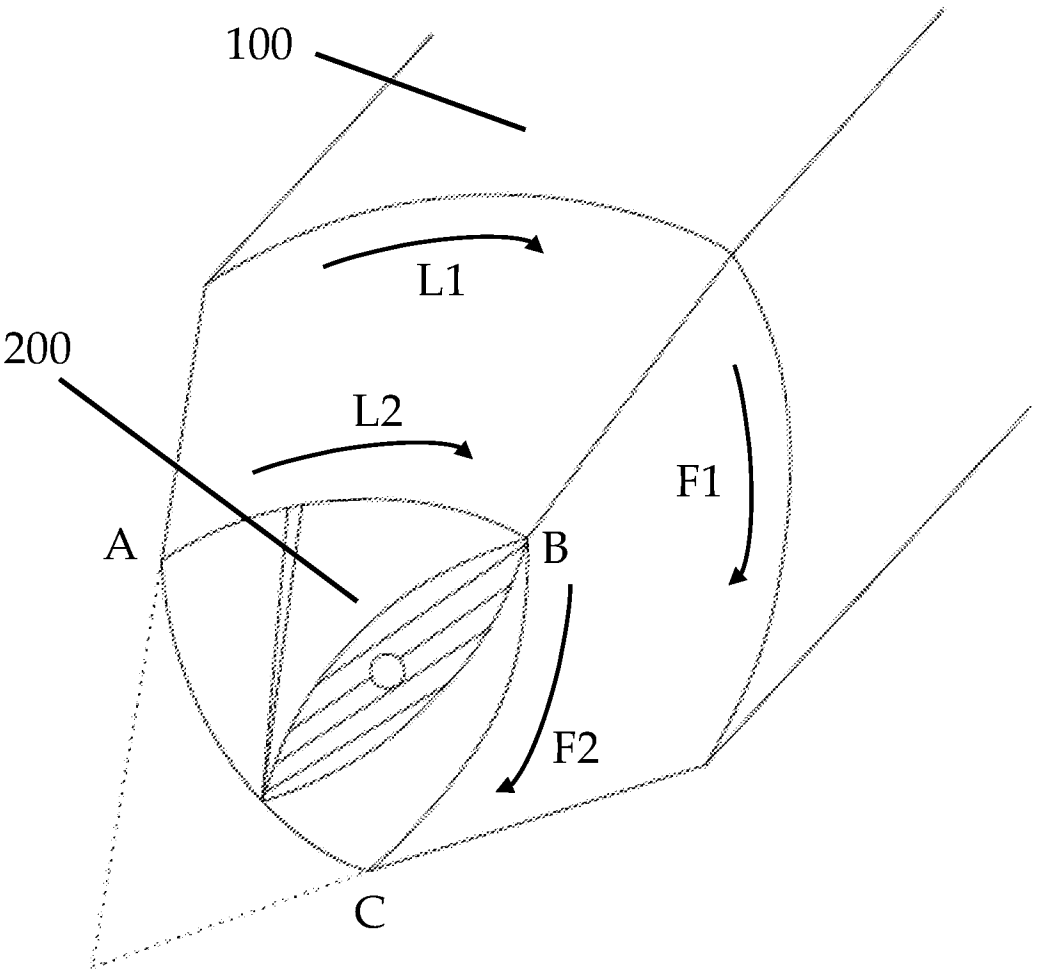
FIG. 8 is a front cross-sectional view of the air compressor showing the rotator inside the compressor body according to an aspect of the embodiment.

FIGS. 7-9 generally depict the air compressor according to an aspect of the embodiment.

Referring to FIG. 7, in some embodiments, the rotator 200 may comprise an end portion 202 having a trapezoid shape, wherein the end portion 202 comprises a flat surface 2021. In some embodiments, the air compressor may further comprise a rotatable axis 203 passed through the flat surface 2021 of the rotator 200 and a motor 204 coupled to the rotatable axis 203 to activate the exhaust and intake cycles. In some embodiments, the rotator 200 may further comprise a body portion 205 contacted to the end portion 202, wherein the end portion 202 may further comprise two side surfaces 2022 inwardly and integrally extended towards the flat surface 2021.

Continuing to FIGS. 7-8, during the exhaust and intake cycles, the rotator 200 may rotate within the compressor body 100 to generate several rotation lengths, wherein the rotation lengths may be defined as a front periphery L2, F2 and a rear periphery L1, F1 of the compressor body 100. In some embodiment, the end portion 202 of the rotator 200 may further comprise a top portion 2023 and a bottom portion 2024 which has a bigger cross-section length than the top portion 2023, wherein the top portion 2023 of the rotator 200 may be rotated along the front periphery L2, F2 of the compressor body 100, and the bottom portion 2024 of the rotator 200 may be rotated along the rear periphery L1, F1 of the compressor body 100. Since the rotator 200 is a trapezoid shape, in order to facilitate the exhaust and intake cycles of the rotator 200 inside the compressor body 100, the compressor body 100 may also be a trapezoid shape, and in such a manner, a length of the front periphery L2, F2 may be smaller than a length of the rear periphery L1, F1.

It should be noted that, in one embodiment, the football shape and/or fusiform shape rotator 200 may provide a more stable rotation motion. In addition, the triangle shape/triangular prism compressor body 100 with the football shape and/or fusiform shape rotator may provide high power with lower fuel consumption. According to the above-mentioned embodiments, the front end "D" of the rotator 200 may be moving along a periphery (either the first periphery 111, the second periphery 112, or the third periphery 113) of the compressor body 100 and the rear end "E" of the rotator 200 may be biased against the corner point (either the first point "A", the second point "B", and the third point "C") located opposite of the periphery (either the first periphery 111, the second periphery 112, or the third periphery 113).

In still some embodiments, during the exhaust and intake cycles, the compressor body 100 comprises a main periphery and two side peripheries, wherein the main periphery may be the first periphery 111, and the two side peripheries may be the second periphery 112 and the third periphery 113. In still some embodiments, the main periphery may be the second periphery 112, and the two side peripheries may be the first periphery 111 and the third periphery 113. In still some embodiments, the main periphery may be the third periphery 113, and the two side peripheries may be the first periphery 111 and the second periphery 112. In still some embodiments, the front end "D" of the rotator 200 may be moving along the main periphery (either the first periphery 111, the second periphery 112, or the third periphery 113) of the compressor body 200 and the rear end "E" of the rotator 200 may be biased against the corner point (either the first point "A", the second point "B", or the third point "C") located opposite of the main periphery (either the first periphery 111, the second periphery 112, or the third periphery 113), and in such a way, the two side peripheries, which is different from the main periphery of the compressor body 100, may be located on two opposite sides of the rotator 200.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of the air compressor have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. An air compressor comprising:

a compressor body;

a rotator located inside the compressor body and configured to define an exhaust compartment and an intake compartment;

a plurality of exhaust openings and a plurality of intake openings formed on the compressor body;

wherein the rotator is rotated within the compressor body and configured to intake air or fluid in the compressor body and exhaust air or fluid out of the compressor body to operate exhaust and intake cycles, wherein the compressor body comprises a first point, a second point, and a third point, wherein the compressor body comprises a first periphery defined between the first point and the second point, a second periphery defined between the second point and the third point, and a third periphery defined between the third point and the first point/wherein wherein the rotator comprises an end portion having a trapezoid shape, and the end portion comprises a flat surface where a rotatable axis is passed through and the rotatable axis is coupled to a motor to activate the exhaust and intake cycles.

2. The air compressor of claim 1, wherein the rotator is clockwisely rotated along a center point of the rotator within the compressor body.

3. The air compressor of claim 1, wherein the rotator has a fusiform shape or a football shape and is wider in a body portion, wherein two sides of the body portion taper to form two end portions.

4. The air compressor of claim 1, wherein the compressor body is a triangle shape and comprises a triangular shape cavity and the rotator is rotated sixty degrees within the compressor body to operate one exhaust cycle and intake cycle.

5. The air compressor of claim 1, wherein the rotator comprises a front end biased against an inner surface of the compressor body and a rear end biased against the inner surface of the compressor body, wherein a rotator length is defined by the front end and the rear end.

6. The air compressor of claim 1, wherein the rotator comprises a front end and a rear end, and a rotator length defined by the front end and the rear end, wherein the rotator length is smaller than a length of the first periphery, a length of the second periphery, and a length of the third periphery.

7. The air compressor of claim 1, wherein the compressor body comprises a first periphery integrally extended to a second periphery, and a third periphery integrally extended between the first and the second periphery.

8. The air compressor of claim 7, wherein at least one of the plurality of exhaust openings are formed on each of the first periphery, the second periphery, and the third periphery, wherein the air or the fluid is exhausted out the exhaust compartment via the exhaust openings.

9. The air compressor of claim 7, wherein at least one of the plurality of intake openings are formed on each of the first periphery, the second periphery, and the third periphery, wherein the air or fluid is entered into the intake compartment via at least one of the plurality of intake openings.

10. The air compressor of claim 1, wherein the rotator comprises a front end biased against the first point and a rear end is biased against the third point.

11. The air compressor of claim 10, wherein, during the exhaust and intake cycles, the front end of the rotator is moving towards the second point and a volume of the exhaust compartment is gradually decreased, and synchronously a volume of the intake compartment is gradually increased.

12. The air compressor of claim 10, wherein during the exhaust and intake cycles, an exhaust opening of the plurality of exhaust openings formed on the second periphery of the compressor body configured to define the exhaust compartment is opened and an intake opening of the plurality of intake openings formed on the third periphery of the compressor body is opened.

13. The air compressor of claim 1, wherein the rotator comprises a front end biased against the second point and a rear end is biased against the third point.

14. The air compressor of claim 13, wherein, during the exhaust and intake cycles, the rear end of the rotator is moving towards the first point and a volume of the exhaust compartment is gradually decreased, and synchronously a volume of the intake compartment is gradually increased.

15. The air compressor of claim 13, wherein during the exhaust and intake cycles, an exhaust opening of the plurality of exhaust openings formed on the first periphery of the compressor body configured to define the exhaust compartment is opened and an intake opening of the plurality of intake openings formed on the second periphery of the compressor body is opened.

16. The air compressor of claim 1, wherein the rotator comprises a front end moving along a periphery of the compressor body and a rear end biased against a corner point located opposite of the periphery, wherein the compressor body further comprises two side peripheries located on two opposite sides of the rotator.

17. The air compressor of claim 16, wherein during the exhaust and intake cycles, an exhaust opening of the plurality of exhaust openings and an intake opening of the plurality of intake openings formed on the periphery are closed.

18. The air compressor of claim 1, wherein the compressor body consists of the rotator inside the cavity.

* * * * *